US010211554B2

(12) United States Patent
Zhou et al.

(10) Patent No.: US 10,211,554 B2
(45) Date of Patent: Feb. 19, 2019

(54) SUPPORTED AND HIDDEN SURFACE MOUNT CONTACT TAILS OF ELECTRICAL CONNECTOR

(71) Applicant: FOXCONN INTERCONNECT TECHNOLOGY LIMITED, Grand Cayman (KY)

(72) Inventors: Shao-Cong Zhou, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/856,098

(22) Filed: Dec. 28, 2017

(65) Prior Publication Data

US 2018/0191092 A1 Jul. 5, 2018

(30) Foreign Application Priority Data

Dec. 29, 2016 (CN) ..... 2016 2 1469953 U

(51) Int. Cl.

| | |
|---|---|
| ***H01R 12/71*** | (2011.01) |
| ***H01R 13/405*** | (2006.01) |
| ***H01R 13/504*** | (2006.01) |
| ***H01R 13/6471*** | (2011.01) |
| ***H01R 12/70*** | (2011.01) |

(Continued)

(52) U.S. Cl.

CPC ..... *H01R 12/716* (2013.01); *H01R 12/707* (2013.01); *H01R 13/405* (2013.01); *H01R 13/5045* (2013.01); *H01R 13/6471* (2013.01); *H01R 12/725* (2013.01); *H01R 13/6585* (2013.01); *H01R 24/60* (2013.01); *H01R 2107/00* (2013.01)

(58) Field of Classification Search

CPC H01R 12/716; H01R 13/405; H01R 13/5045; H01R 13/6471; H01R 13/6585

USPC ..... 439/78, 607.11, 607.13

See application file for complete search history.

(56) References Cited

U.S. PATENT DOCUMENTS

| | | | | |
|---|---|---|---|---|
| 9,431,753 | B2 * | 8/2016 | Wu | H01R 13/6593 |
| 9,768,544 | B2 * | 9/2017 | Du | H01R 13/521 |

(Continued)

FOREIGN PATENT DOCUMENTS

| | | | |
|---|---|---|---|
| CN | 20385925 | U | 10/2014 |
| CN | 107305985 | A | 4/2016 |

*Primary Examiner* — Tulsidas C Patel
*Assistant Examiner* — Travis Chambers
(74) *Attorney, Agent, or Firm* — Wei Te Chung; Ming Chieh Chang

(57) ABSTRACT

An electrical connector is mounted to a printed circuit board and includes an insulative housing and a number of upper and lower terminals affixed to the insulative housing. The insulative housing includes a base portion having a mounting portion extending rearward from the base portion, and a mating tongue extending forwardly from the base portion. The mounting portion includes a mounting surface mounted to the printed circuit board and an rear surface. Each terminal has a contacting portion exposed to two exposed surfaces of the mating tongue, a fixed portion and a tail extending rearward from the fixed portion. The tails of the upper terminals parallel to the mounting surface are a number of horizontal rear tails located in a rear end of the tails of the lower terminals. The horizontal rear tails extend rearward and are located in front of the rear surface.

18 Claims, 11 Drawing Sheets

(51) Int. Cl.

| | |
|---|---|
| *H01R 13/6585* | (2011.01) |
| *H01R 12/72* | (2011.01) |
| *H01R 24/60* | (2011.01) |
| *H01R 107/00* | (2006.01) |

(56) References Cited

U.S. PATENT DOCUMENTS

| | | | | |
|---|---|---|---|---|
| 9,912,106 | B2 * | 3/2018 | Yao | H01R 13/6594 |
| 2015/0372424 | A1 * | 12/2015 | Little | H01R 13/642<br>439/217 |
| 2017/0077654 | A1 * | 3/2017 | Yao | H01R 13/6594 |
| 2017/0288326 | A1 * | 10/2017 | Wang | H01R 11/12 |
| 2017/0352968 | A1 * | 12/2017 | Zhang | H01R 12/55 |

* cited by examiner

SUPPORTED AND HIDDEN SURFACE MOUNT CONTACT TAILS OF ELECTRICAL CONNECTOR

BACKGROUND OF THE DISCLOSURE

1. Field of the Disclosure

The present disclosure relates to an electrical connector, and more particularly to an electrical connector adapted for normally and reversely mating.

2. Description of Related Arts

China Patent No. 204947243 discloses a receptacle connector including an insulative housing, two rows of contacts affixed to the insulative housing, a shielding plate affixed to the insulative housing and a shielding shell enclosing the insulative housing for forming a mating room. The shielding plate includes a pair of grounding pins bending laterally. Each contact includes a contacting portion, a fixed portion extending from the contacting portion and a tail extending from the fixed portion. The tail includes a soldering pin extending out from an rear surface of the insulative housing and soldering to a printed circuit board. However the soldering pin is easily to be friction and collapsed when assembling the electrical connector.

An improved electrical connector is desired.

SUMMARY OF THE DISCLOSURE

Accordingly, an object of the present disclosure is to provide an electrical connector that effectively improves the deformability of a conductive terminal To achieve the above object, an electrical connector is mounted to a printed circuit board and includes an insulative housing and a number of upper and lower terminals affixed to the insulative housing. The insulative housing includes a base portion having a mounting portion extending rearward from the base portion, and a mating tongue extending forwardly from the base portion. The mounting portion includes a mounting surface mounted to the printed circuit board and an rear surface. Each terminal has a contacting portion exposed to two exposed surfaces of the mating tongue, a fixed portion and a tail extending rearward from the fixed portion. The tails of the upper terminals parallel to the mounting surface are a number of horizontal rear tails located in a rear end of the tails of the lower terminals. The horizontal rear tails extend rearward and are located in front of the rear surface Other objects, advantages and novel features of the disclosure will become more apparent from the following detailed description when taken in conjunction with the accompanying drawings.

DETAILED DESCRIPTION OF THE PREFERRED EMBODIMENT

Figure 1:
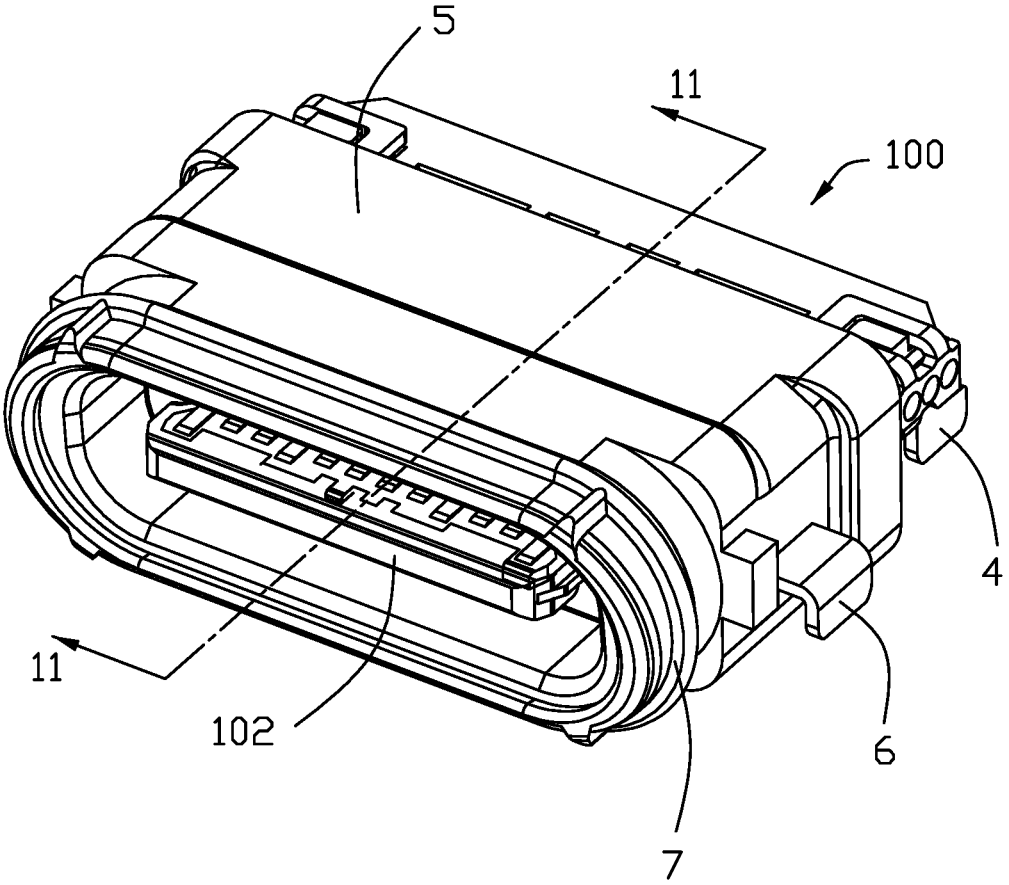
FIG. 1 is a perspective, assembled view of an electrical connector.
Figure 2:
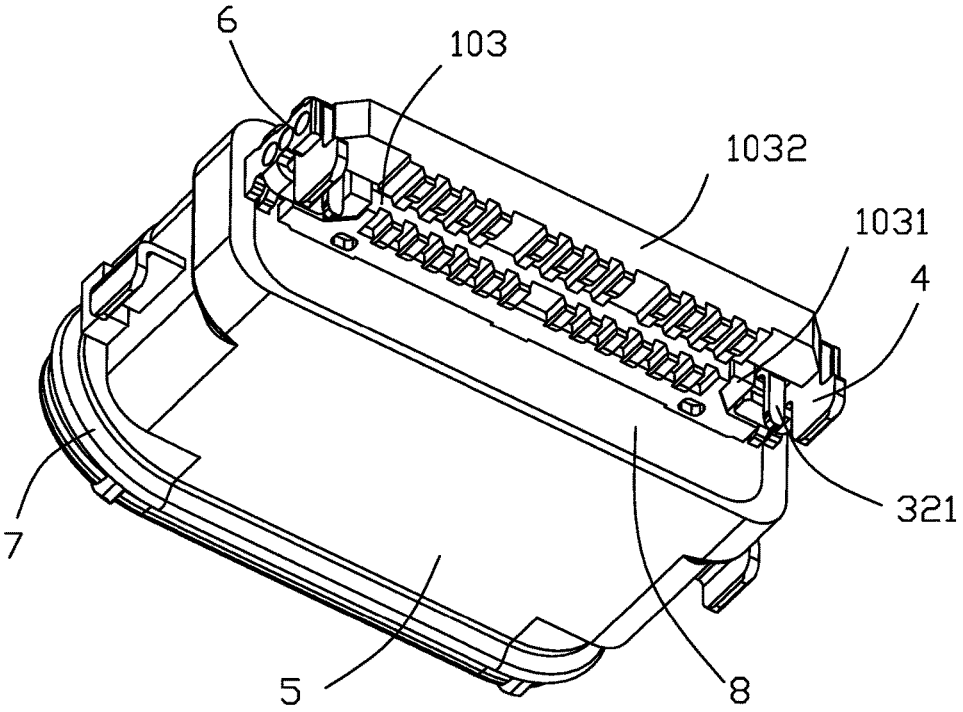
FIG. 2 is another perspective, assembled view of the electrical connector taken from FIG. 1.
Figure 3:
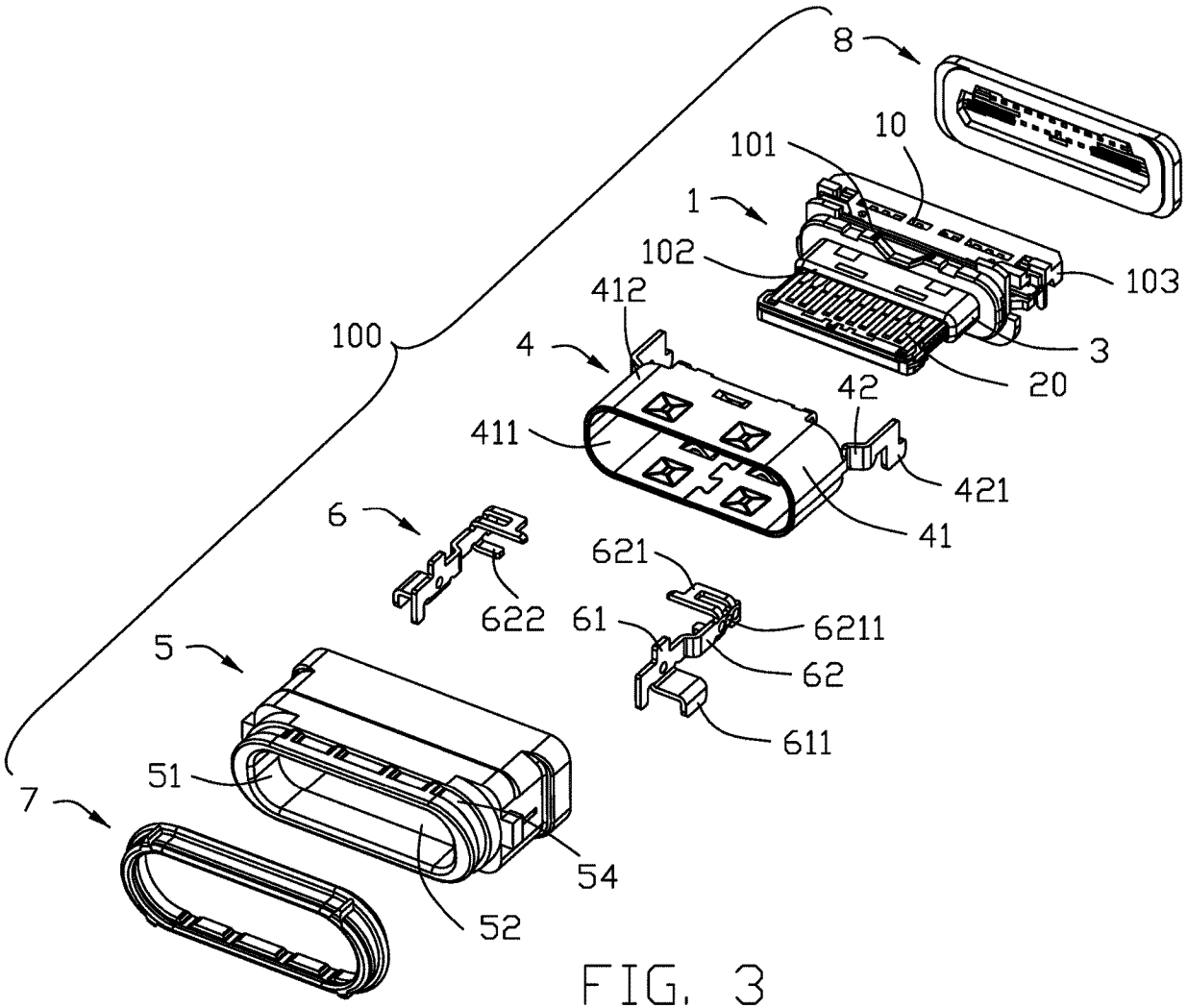
FIG. 3 is an exploded view of the electrical connector taken from FIG. 1.
Figure 4:
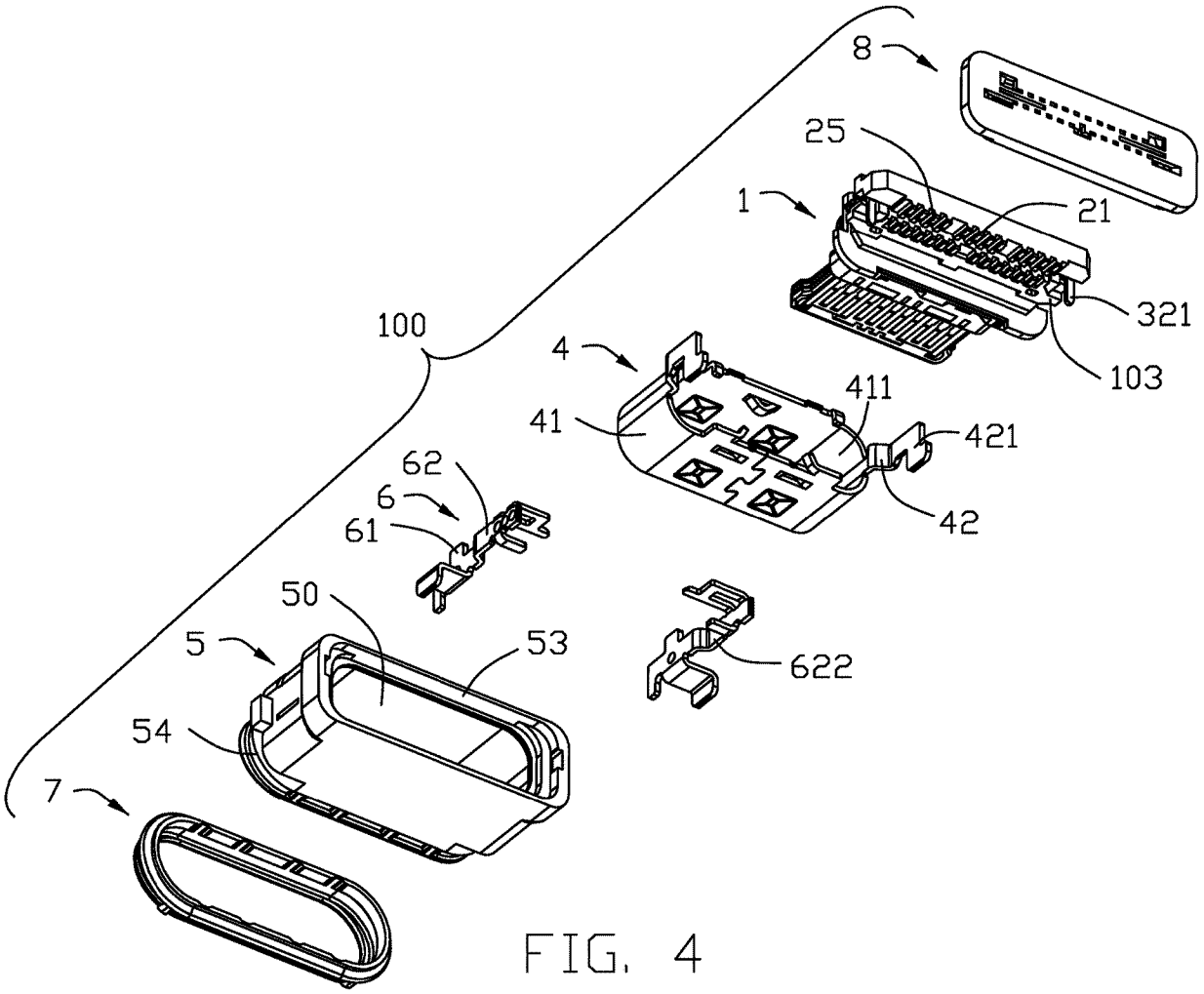
FIG. 4 is an exploded view of the electrical connector taken from FIG. 2.

Reference will now be made in detail to the embodiments of the present disclosure. The insertion direction is a front-to-rear direction.

Referring to FIGS. 1 to 11, an electrical connector 100 assembled to a printed circuit board (PCB) (not shown) is mated with a corresponding electrical connector (not shown). The electrical connector 100 includes a contact module 1, a shielding shell 4 enclosing the contact module 1, an insulative shell 5 integrated with the shielding shell 4, a pair of supporting structures 6 affixed to the insulative shell 5, an o-ring 7 affixed to a front end of the insulative shell 5, and a sealing member 8 located at an rear end of the electrical connector.

Referring to FIGS. 1 to 8, the contact module 1 includes an insulative housing 10, two rows of terminals 20 affixed to the insulative housing 10 and a pair of shielding plates 3 embedded in the insulative housing 10. The contact module 1 includes an upper contact module 1*b* and a lower contact module 1*a*.

The insulative housing 10 includes a base portion 101 and a mating tongue 102 extending forwardly from the base portion 101. The base portion 101 includes a mounting portion 103 extending rearward from the base portion 101. The mating tongue 102 includes a pair of exposed surfaces 1021 in a vertical direction, a stepped portion 1022 thickened and abutting the base portion 101, and a pair of mating slots 1023 located laterally. The mounting portion 103 includes a mounting surface 1031 mounting to the printed circuit board and an rear surface 1032. The insulative housing 10 includes a first insulator 11, a second insulator 12 and a third insulator 13 or insulative cover through an insert-molding or over-molding process. The first/lower insulator 11 includes a first base portion 111 and a first tongue portion 112 extending forwardly from the first base portion 111. The first base portion 111 includes a first mounting portion 113 extending rearward from the first base portion 111. The second/upper insulator 12 includes a second base portion 121 and a second tongue portion 122 extending forwardly from the second base portion 121. The second base portion 121 includes a second mounting portion 123 extending rearward from the second base portion 121. The third insulator 13 includes a third base portion 131 and a third tongue portion 132 extending forwardly from the third base portion 131. The first mounting portion 113 includes a first mounting surface 1131 mounted to the PCB and a first rear surface 1132. The second mounting portion 123 includes a second mounting surface 1231 mounted to the PCB and a second rear surface 1232. The first base portion 111, the second base portion 121 and the third base portion 131 form the base portion 101. The first tongue portion 112, the second tongue portion 122 and the third tongue portion 132 form the mating portion 102. The first mounting portion 113 and the second mounting portion 123 form the mounting portion 103.

The first mounting portion 113 includes a pair of fixed laps 1133 located at two lateral sides of an rear end thereof. The first tongue portion 112 includes a pair of first protrusions 1121. The second base portion 121 includes a pair of tubers 1211 extending upwardly from an upper surface of two lateral sides of the second base portion 121 and a pair of rear wall 1212 located in front of the tubers 1211. The second tongue portion 122 includes a pair of second protrusions 1221 opposite to the first protrusions 1221. The front surfaces of the second tongue portion 122 are not in the same plane due to the different lengths of the terminals 20 retained in the second insulator 12. The third base portion 131 includes a number of resisting grooves 1311 located at a front end thereof and four blocking portions 1312 located at an rear end thereof. The blocking portions 1312 are divided into upper pair and lower pair located at the rear end of the third base portion 131. Each pair of blocking portions 1312 is symmetrically disposed on a pair of lateral sides of the third base portion 131. Each blocking portion 1312 is an arc-shaped. There exists a vacancy between the upper pair of the blocking portions 1312 and the lower pair of the blocking portions 1312 for being resisted of the shielding shell 4 avoiding glue going into the electrical connector when forming the sealing member 8.

Figure 9:
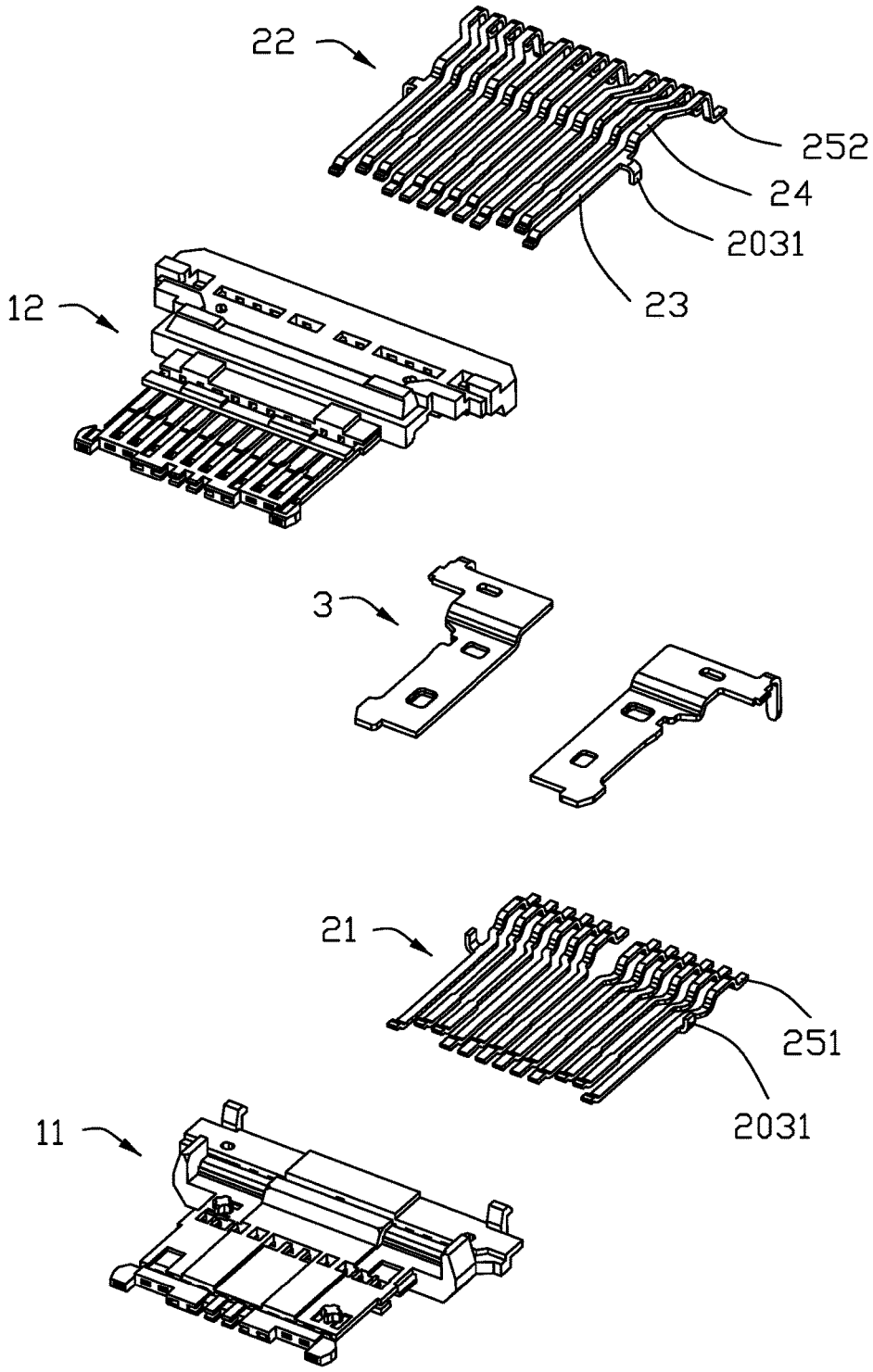
FIG. 9 is a further exploded view of the contact module taken from FIG. 7.
Figure 10:
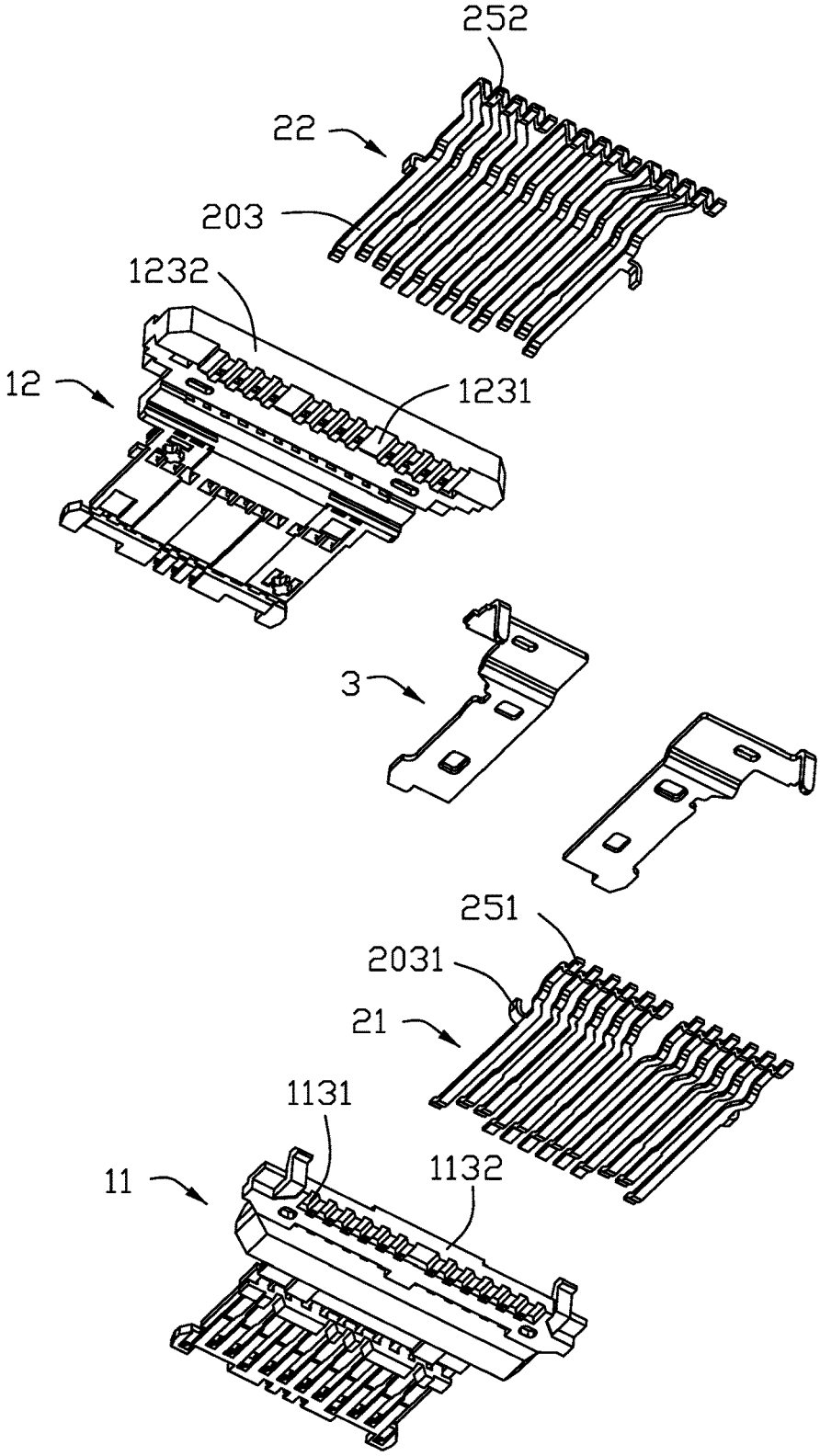
FIG. 10 is another further exploded view of the contact module taken from FIG. 8.
Figure 11:
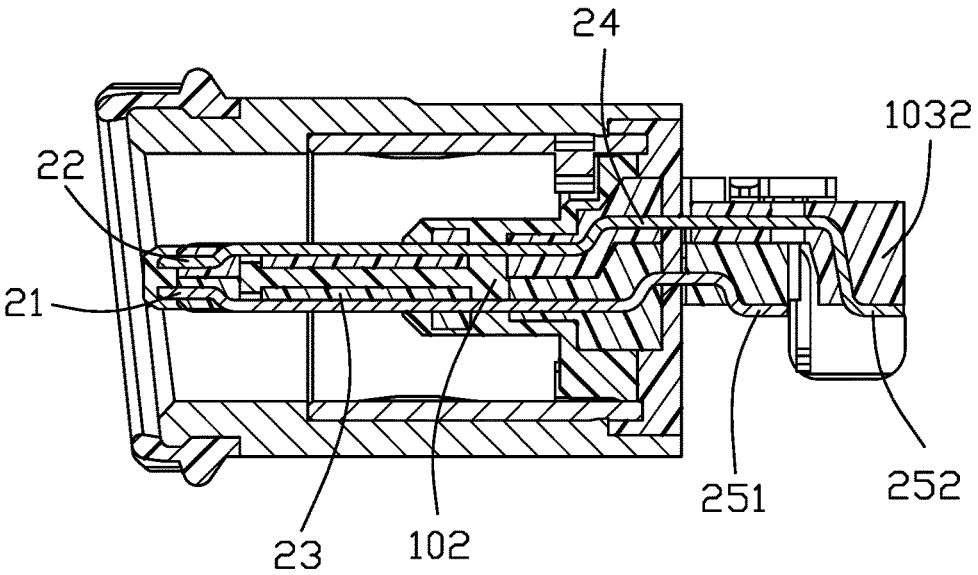
FIG. 11 is a cross-sectional view of the electrical connector taken from line XI-XI in FIG. 1.

Referring to FIGS. 1 to 8, the terminals 20 include a row of lower terminals 21 embedded in the lower contact module 1*a* and a row of upper terminals 22 embedded in the upper contact module 1*b* and both affixed to the insulative housing 10. The lower terminals 21 are insert-molded with the first insulator 11 to form the lower contact module 1*a*. The upper terminals 22 are insert-molded with the second insulator 12 to form the upper contact module 1*b*. Referring to FIGS. 9 to 11, each row of the terminals 20 include a pair of power terminals 201 separated from each other, two pairs of signal terminals 204 located between the pair of power terminals 201, two pairs of high-frequency differential terminals 202 located outside of the power terminals 201, and a pair of ground terminals 203 located outside of the high-frequency differential terminals 202. Each terminal 20 includes a contacting portion exposed to the exposed surface 1021 respectively, a fixed portion 24 affixed to the mating tongue 102 and the base portion 101, and a tail 25 extending rearward from the fixed portion 24. Each ground terminal 203 includes a buckling portion 2031 bending from an edge of the ground terminal and buckling with an edge of the first insulator 11 and the second insulator 12. The tail 25 of each lower terminal 21 is a horizontal front tail 251 extending along a horizontal direction and in parallel to the mounting surface 1031. The tail 25 of each upper terminal 22 is a horizontal rear tail 252 extending along the horizontal direction and in parallel to the mounting surface 1031. The horizontal front tail 251 is in front of the horizontal rear tail 252. The horizontal rear tail 252 extending rearward and does not protrude beyond the rear surface 1032 of the insulating housing 10. The horizontal rear tails 252 are arranged in three groups with the distance between each group being greater than the distance between adjacent terminals in the group. The horizontal front tails 251 are arranged in two groups with the distance between each group being greater than the distance between adjacent terminals. The horizontal front tails 251 extend rearward and do not protrude beyond the first rear surface 1132 of the first insulator 11. The horizontal rear tails 252 extend rearward and do not protrude beyond the second rear surface 1232 of the second insulator 12. Notably, the first mounting portion 113 of the first insulator 11 forms a plurality of ribs with alternate grooves thereof (not labeled) on which the tails 251 are seated, and the second mounting portion 123 of the second insulator 12 forms a plurality of ribs with alternate grooves thereof (not labeled) on which the tails 252 are seated. The integration between the contacts and the insulator, and the abutment of the tail against the insulator may provide superior precision to the tails, thus assuring better soldering upon the printed circuit board.

Referring to FIGS. 7 to 10, the pair of shielding plates 3 are sandwiched between the first insulator 11 and the second insulator 12. Each shielding plate 3 includes a first plate 31 embedded in the mating tongue 102 and including a locking edge 311 protruding outward from the lateral sides of the mating slot 1023, a second plate 32 embedded in the base portion 101, and a connecting portion 33 connecting the first plate 31 and the second plate 32. The first plate 31 and the second plate 32 both include through holes 312. Each shielding plate 3 further includes a soldering pin 321 going through the mounting portion 103 and extending downwardly and through the mounting surface 1031. The horizontal front tails 251 extend rearward and do not protrude beyond the soldering pin 321.

Referring to FIGS. 1 to 4, there is no gap between the shielding shell 4 and the insulative shell 5. The shielding shell 4 is made of metal material and has a cylindrical shape and penetrates the insulative shell 5 in a lengthwise direction. The shielding shell 4 includes a main portion 41 and a pair of lateral arms 42 extending rearward from two lateral sides of the main portion 41. The main portion 41 includes an annular-shaped inner surface 411 and an outer cylindrical outer surface 412. Each of the lateral arms 42 further includes a grounding pin 421 extending downwardly from the tail.

Figure 5:
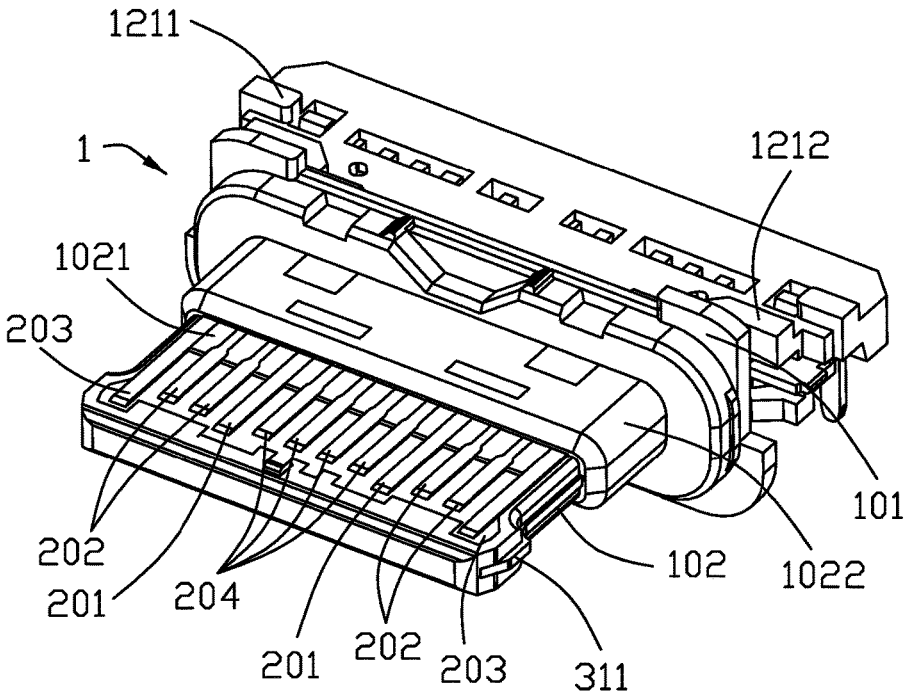
FIG. 5 is a perspective, assembled view of a contact module taken from FIG. 3.
Figure 6:
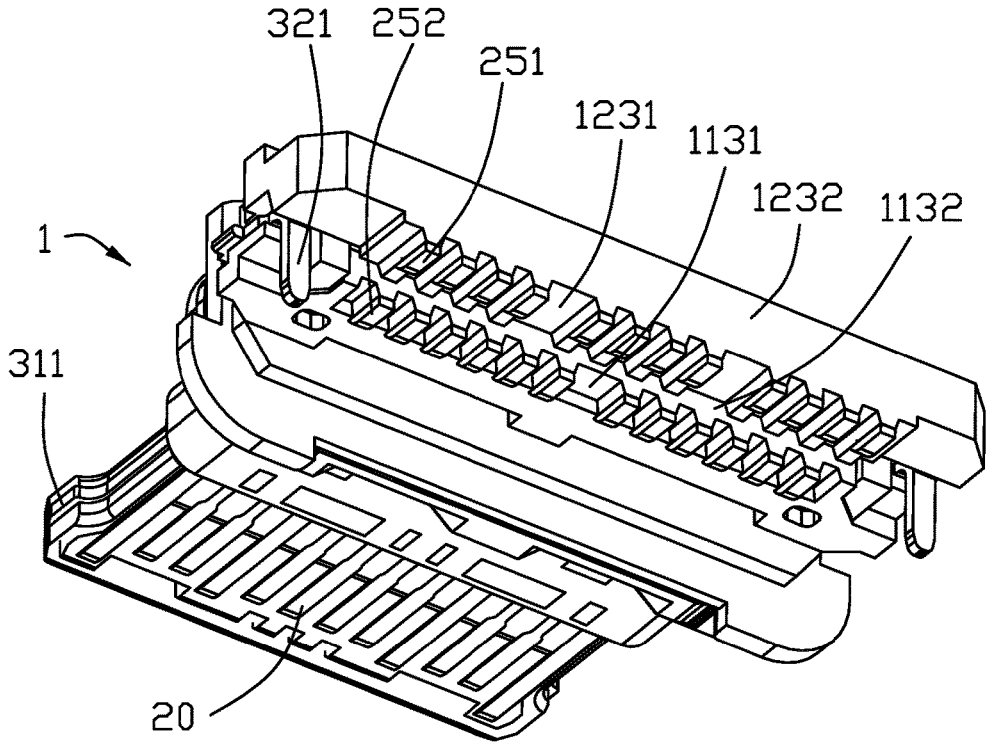
FIG. 6 is another perspective, assembled view of the contact module taken from FIG. 4.
Figure 7:
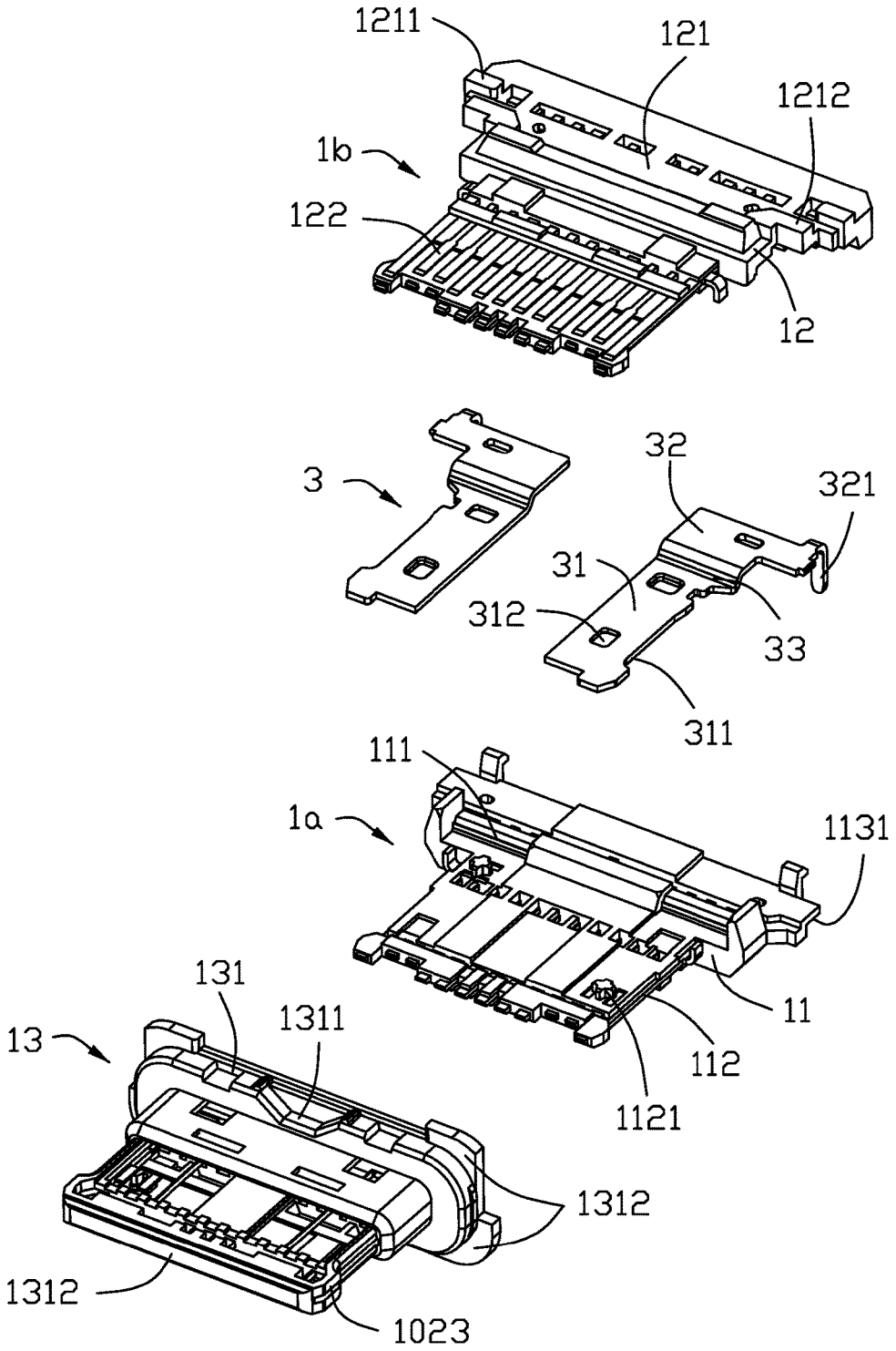
FIG. 7 is a partial exploded view of the contact module taken from FIG. 5.
Figure 8:
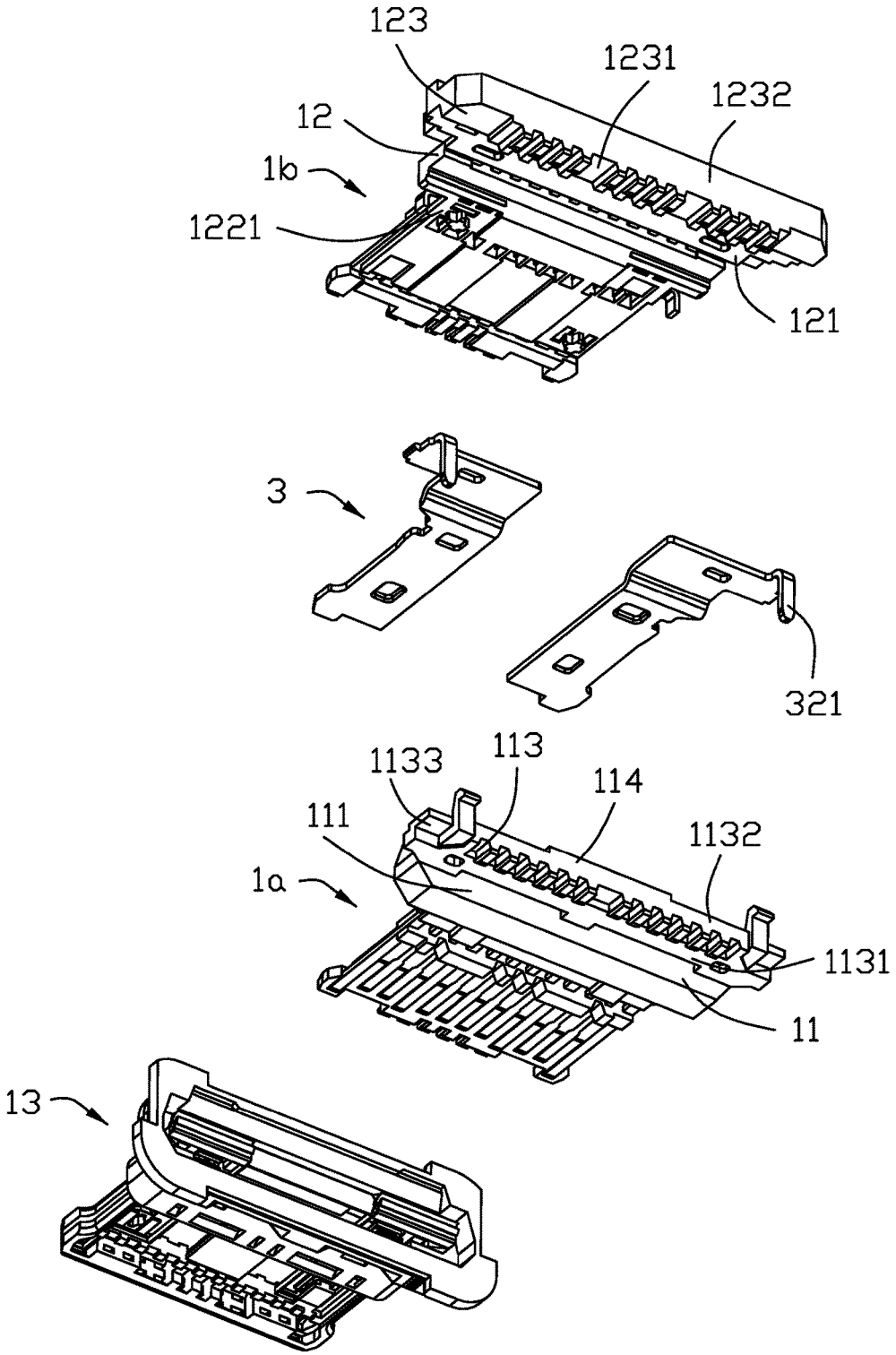
FIG. 8 is another partial exploded view of the contact module taken from FIG. 6.

The insulative shell 5 includes a first inner wall 51 located in the front thereof, a third inner wall 53 located at an rear end thereof, and a second inner wall 52 connecting the first inner wall 51 and the third inner wall 53. The outer surface 412 of the shielding shell 4 is attached to the second inner wall 52 of the insulative shell 5. The O-ring is attached to an outer surface of the first inner wall 51. Referring to FIGS. 5 and 6, the blocking portions 1312 of the third insulator 13 is received in cylindrical third inner wall 53. The first inner wall 51 is aligned with the inner surface 411 of the main portion 41. There forms a mating room 50 between the first inner wall 51 and the mating tongue 102 for mating with the corresponding electrical connector.

The supporting structures 6 are separated from each other and arranged symmetrically. The supporting structures 6 are insert-molded with the insulative shell 5. Each supporting structure 6 includes an embedded portion 61 affixed to the insulative shell and an affixed arm 62 extending rearward out from a rear end of the insulative shell 5. The embedded portion 61 extends laterally out from the insulative shell 5 and bends downwardly. The embedded portion 61 includes a supporting arm 611 extending laterally. The affixed arm 62 includes a locking arm 621 extending laterally from an upper surface of the affixed arm 62, and a resisting portion 622 extending laterally from a lower surface of the affixed arm 62. The locking arm 621 includes an opening 6211 mated with the tuber 1211 of the second base portion 121. The resisting portion 622 is mated with the fixed lap 1133 of the first base portion 111.

Compared with the prior arts, the horizontal front tail 251 in front of the first rear surface 1132 and the horizontal rear tail 252 in front of the second rear surface 1232 make the terminals 20 not collapsed by other elements when assembling the electrical connector 100.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector mounted to a printed circuit board and comprising:

an insulative housing comprising a base portion comprising a mounting portion extending rearward from the base portion, and a mating tongue extending forwardly from the base portion, the mounting portion comprising a mounting surface mounted to the printed circuit board and a rear surface;

a plurality of shielding plates embedded in the insulative housing; and a plurality of upper and lower terminals affixed to the insulative housing and each having a contacting portion exposed to a corresponding one of two exposed surfaces of the mating tongue, a fixed portion and a tail extending rearward from the fixed portion, wherein the tails of the upper terminals parallel to the mounting surface are a plurality of horizontal rear tails located behind the tails of the lower terminals, and the horizontal rear tails extend rearward and are located in front of the rear surface, the tails of the lower terminals are a plurality of horizontal front tails parallel to the mounting surface, and each shielding plate has a locking edge exposed to a lateral side of the mating tongue and a soldering pin extending downwardly through the mounting surface and the horizontal front tails extend rearward and are located in front of the soldering pin.

2. The electrical connector as claimed in claim 1, wherein the horizontal rear tails are arranged in three groups with the distance between each group being greater than the distance between adjacent terminals in the group, and the horizontal front tails are arranged in two groups with the distance between each group being greater than the distance between adjacent terminals.

3. The electrical connector as claimed in claim 1, wherein the shielding plates are arranged in two groups and each group has one shielding plate, each shielding plate comprises a first plate embedded in the mating tongue, a second plate affixed to the base portion, and a connecting portion connecting the first plate and the second plate, the soldering pin bends downwardly from the second plate.

4. The electrical connector as claimed in claim 1, wherein the electrical connector comprises an upper contact module having a second insulator and the upper terminals and a lower contact module having a first insulator and the lower terminals, the horizontal front tails extend rearward and do not protrude beyond a rear surface of the first insulator, and the horizontal rear tails extend rearward and do not protrude beyond a rear surface of the second insulator.

5. The electrical connector as claimed in claim 4, wherein the insulative housing comprises the first insulator, the second insulator and a third insulator insert-molded with the first insulator and the second insulator, the lower terminals are insert-molded with the first insulator to form the lower contact module, and the upper terminals are insert-molded with the second insulator to form the upper contact module.

6. The electrical connector as claimed in claim 5, wherein each row of the terminals comprise a pair of power terminals separated from each other, two pairs of signal terminals located between the pair of power terminals, two pairs of high-frequency differential terminals located outside of the power terminals, and a pair of ground terminals located outside of the high-frequency differential terminals, and each ground terminal comprises a buckling portion bending from an edge of the ground terminal and buckling with an edge of the first insulator and the second insulator.

7. The electrical connector as claimed in claim 1, wherein the electrical connector further comprises a shielding shell enclosing the insulative housing and an insulative shell integrated with the shielding shell, and the shielding shell is shown as a cylindrical shape and penetrates in a lengthwise direction.

8. The electrical connector as claimed in claim 7, wherein the electrical connector comprises a pair of supporting structures separated from each other and arranged symmetrically, the supporting structures are made of metal materials, and the insulative shell is insert-molded with the supporting structures.

9. An electrical connector comprising:

a contact module enclosed within a metallic shielding shell and including an upper contact module and a lower contact module commonly sandwiching a metallic shielding plate therebetween in a vertical direction and further commonly integrally formed with an insulative cover;

the upper contact module including a plurality of upper contacts integrally formed with an upper insulator via an insert-molding process, each of said upper contacts including an upper contacting section and an upper tail;

the lower contact module including a plurality of lower contacts integrally formed with a lower insulator via an insert-molding process, each of said lower contacts including a lower contacting section and a lower tail;

the upper insulator, the lower insulator and the insulative cover commonly forming an insulative housing having a base portion, and a mating tongue forwardly extending from the base and defining opposite upper surface and lower surface thereon, and the upper contacting sections of said upper contacts being exposed upon the upper surface, and the lower contacting sections of the lower contacts being exposed upon the lower surface; wherein the lower tails of the lower contacts are located in front of and is coplanar with the upper tails of the upper contacts in a horizontal plane perpendicular to said vertical direction, and the upper tails of said upper contacts upwardly abut against the upper insulator and the lower tails of said lower contacts upwardly abut against the lower insulator, and the upper insulator forms a rear face constituting a boundary of the connector on a rear end, and the upper tails are located in front of the rear face in a hidden manner.

10. The electrical connector as claimed in claim 9, wherein the upper insulator forms a plurality of ribs on a mounting portion to support the upper tails, respectively, and the lower insulator forms a plurality of ribs on another mounting portion to support the lower tails, respectively.

11. An electrical connector mounted to a printed circuit board and comprising:

an insulative housing comprising a base portion comprising a mounting portion extending rearward from the base portion, and a mating tongue extending forwardly from the base portion, the mounting portion comprising a mounting surface mounted to the printed circuit board and a rear surface;

a shielding shell enclosing the insulative housing and an insulative shell integrated with the shielding shell; and a plurality of upper and lower terminals affixed to the insulative housing and each having a contacting portion exposed to a corresponding one of two exposed surfaces of the mating tongue, a fixed portion and a tail extending rearward from the fixed portion, wherein the tails of the upper terminals parallel to the mounting surface are a plurality of horizontal rear tails located behind the tails of the lower terminals, and the horizontal rear tails extend rearward and are located in front of the rear surface, and the shielding shell has a cylindrical shape and penetrates the insulative shell in a lengthwise direction.

12. The electrical connector as claimed in claim 11, further comprising a pair of shielding plates, and wherein each shielding plate has a first plate embedded in the mating tongue, a second plate affixed to the base portion, and a connecting portion connecting the first plate and the second plate.

13. The electrical connector as claimed in claim 11, further comprising a pair of supporting structures separated from each other and arranged symmetrically, and wherein the supporting structures are made of metal materials, and the insulative shell is insert-molded with the supporting structures.

14. The electrical connector as claimed in claim 11, wherein the tails of the lower terminals are a plurality of horizontal front tails parallel to the mounting surface.

15. The electrical connector as claimed in claim 14, wherein the horizontal rear tails are arranged in three groups with the distance between each group being greater than the distance between adjacent terminals in the group, and the horizontal front tails are arranged in two groups with the distance between each group being greater than the distance between adjacent terminals.

16. The electrical connector as claimed in claim 14, wherein the electrical connector comprises an upper contact module having a second insulator and the upper terminals and a lower contact module having a first insulator and the lower terminals, the horizontal front tails extend rearward and do not protrude beyond a rear surface of the first insulator, and the horizontal rear tails extend rearward and do not protrude beyond a rear surface of the second insulator.

17. The electrical connector as claimed in claim 16, wherein the insulative housing comprises the first insulator, the second insulator and a third insulator insert-molded with the first insulator and the second insulator, the lower terminals are insert-molded with the first insulator to form the lower contact module, and the upper terminals are insert-molded with the second insulator to form the upper contact module.

18. The electrical connector as claimed in claim 17, wherein each row of the terminals comprise a pair of power terminals separated from each other, two pairs of signal terminals located between the pair of power terminals, two pairs of high-frequency differential terminals located outside of the power terminals, and a pair of ground terminals located outside of the high-frequency differential terminals, and each ground terminal comprises a buckling portion bending from an edge of the ground terminal and buckling with an edge of the first insulator and the second insulator.

* * * * *